US005239291A

United States Patent [19]

Henricks et al.

[11] Patent Number: 5,239,291

[45] Date of Patent: Aug. 24, 1993

[54] MULTI-FUNCTION HEATER ELEMENT FOR DUAL ELEMENT FERRULE FUSES

[75] Inventors: Michael C. Henricks, Manchester; Robert S. Douglass, Glencoe, both of Mo.

[73] Assignee: Cooper Industries, Inc., Houston, Tex.

[21] Appl. No.: 914,820

[22] Filed: Jul. 15, 1992

[51] Int. Cl.[5] ..... H01H 85/04

[52] U.S. Cl. ..... 337/164; 337/162

[58] Field of Search ..... 337/161, 162, 163, 164, 337/165, 166

[56] References Cited

U.S. PATENT DOCUMENTS 4,992,770 2/1991 Spalding et al. ..... 337/166

*Primary Examiner*—Harold Broome

*Attorney, Agent, or Firm*—W. Bruce Patterson; Eddie Scott; Alan R. Thiele

[57] ABSTRACT

A dual element ferrule fuse includes a short circuit element and an overload element. The overload element includes a heater element which, in addition to carrying heat, is designed to partially enclose the overload element with tabs that provide a weldable surface between the element and the metallic end cap, thus eliminating the need for a separate washer. Additionally, the tabs serve to center the element in the end cap and retain the element at a certain point in the fuse body between assembly of the fuse and soldering of the cap to the weldable surface.

7 Claims, 2 Drawing Sheets

FIG. 3A
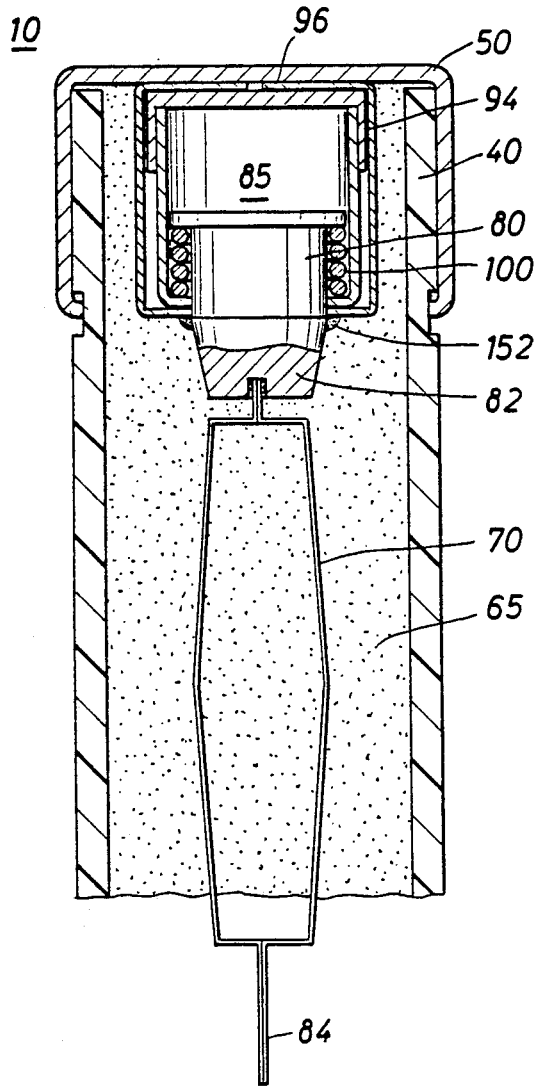
FIG. 3B
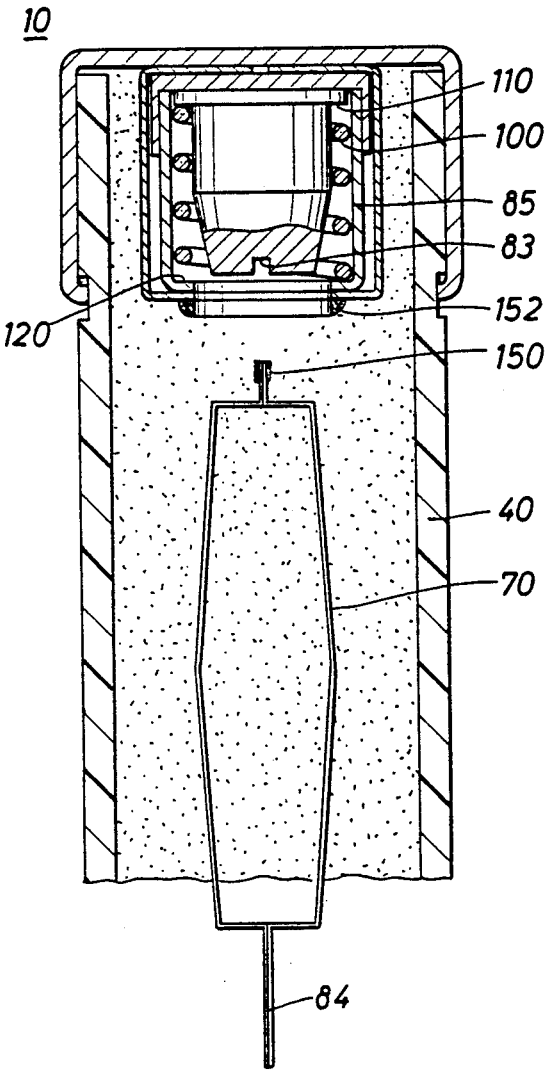
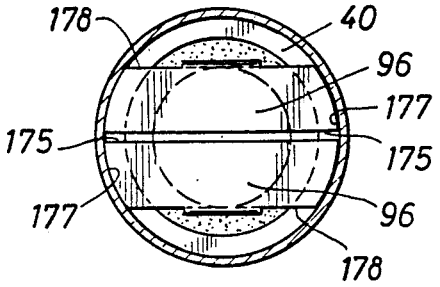
FIG. 4

MULTI-FUNCTION HEATER ELEMENT FOR DUAL ELEMENT FERRULE FUSES

BACKGROUND OF INVENTION

The present invention relates to a dual element ferrule fuse; were specifically, the present invention relates to a dual element fuse wherein the overload element has a heater element including integral tabs which center and index the overload element in the fuse and form a surface for attachment of the element to the end cap.

Dual element fuses are well known in the art and typically include a short circuit element as well as an overload element. The short circuit element usually includes at least one copper alloy or silver strip with weakened areas which melt with overload currents of over 700% of fuse rating. The overload element, installed in series with the short circuit element, includes a spring-loaded trigger with a copper alloy heating element. Upon sustained overload currents of 120–600% rated current, fusing alloy connecting the heater element to parts of the trigger and the trigger to the short circuit element will melt and a compression spring will separate parts of the trigger, thereby opening the electrical circuit.

In assembly, fusible elements are inserted into the fuse body and a terminating washer is placed between the overload element and the metallic end cap. Solder is applied within the end cap and pre-flowed for an even distribution within the cap. The end cap is then installed on the end of the fuse body and external heat is applied to melt the solder. In some cases, current is induced through the end cap, causing the solder to flow thereby connecting the end cap mechanically and electrically to the fuse element. In recent applications, some heater elements have themselves served as terminating washers. However, these integral washers have not been completely effective because they offer no way to keep the fuse element centered in the cap and held at a proper distance in relation to the end of the tubular body prior to soldering the element to the end cap.

There is a need therefore, for a dual element ferrule fuse wherein the heater element portion of the overload element provides a surface for connection of the overload element to the metallic end cap and also provides a means for centering the element in the cap between assembly and soldering of the element to the cap.

There is a further need for a dual element ferrule fuse wherein the heater element provides a surface for connection of the overload element to the end cap and also has means for retaining the element a relative distance from the other element in the fuse body prior to soldering of the cap to the element.

SUMMARY OF INVENTION

A dual element ferrule fuse includes a short circuit element and an overload element. The overload element includes a heater element which, in the event of sustained current overload, will heat sufficiently to melt a fusible alloy and operate a trigger, thereby opening the electrical circuit. In addition to carrying heat, the heater element is designed to partially enclose the overload element with tabs that provide a weldable surface between the element and the metallic end cap, thus eliminating the need for a separate washer. Additionally, the surface formed by the tabs serves to center the element in the end cap and retain the element at a certain point in the fuse body between assembly of the fuse and soldering of the cap to the weldable surface.

BRIEF DESCRIPTION OF THE FIGURES:

FIG. 3A is a sectional view showing the overload element of the fuse in a pre-operated position;

FIG. 3B is a sectional view showing the overload element in its operated state; and FIG. 4 is an end view showing the tabs of the heater element.

Figure 1:
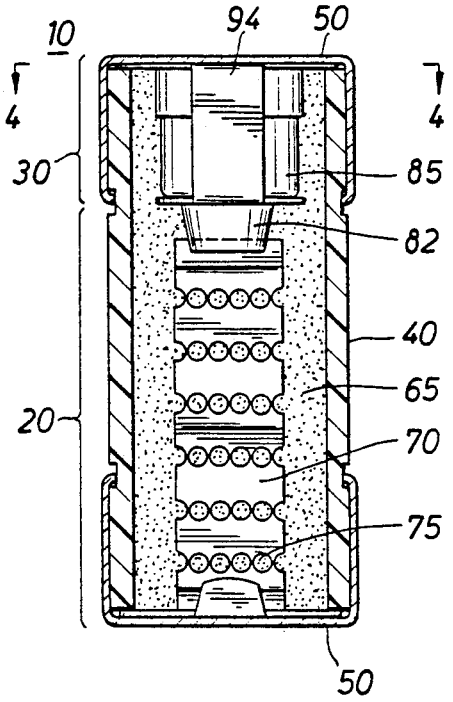
FIG. 1 is a sectional view showing a dual element ferrule fuse.

DESCRIPTION OF AN EMBODIMENT:

The present invention can be best understood by reference to the FIGS. FIG. 1 depicts a dual element fuse 10 that is the subject of the present invention. The fusible elements 20, 30 are housed in a cylindrical tube 40 which is made from heat resistant insulating material like glass or melamine. The elements 20, 30 are electrically connected between two ferrule-like metallic end caps 50 which telescope over the proximal and distal ends of the tube. Dispersed within in the tube around the fusible elements is heat absorbing quartz sand 65. The general external configuration for fuses like 10 are well known and conventional.

At one end of the fuse, the short circuit element 20 comprises at least one copper alloy or silver strip 70 having perforations and partial perforations 75. In the event of a short circuit, the strip 70 will melt at the perforations 75 and open the electrical circuit. The overload element 30 is at the opposite end of the fuse in series with the short circuit element 20. The overload element 30 includes a spring-loaded trigger 80 housed in a barrel 85 and a heater element 90.

Figure 2:
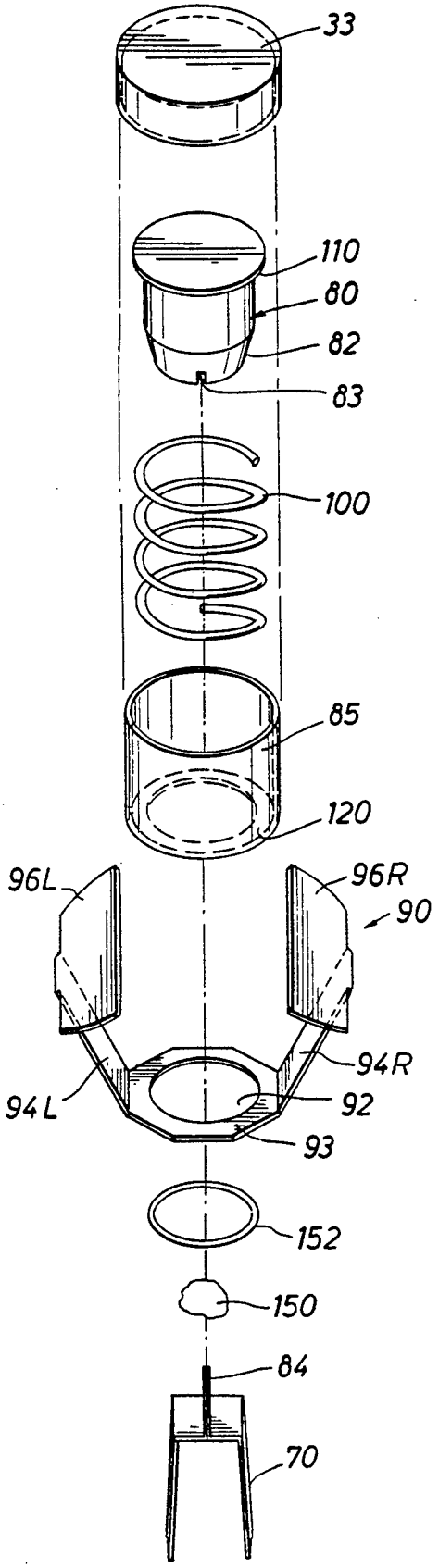
FIG. 2 is an exploded view of the overload device showing the heater element that is the subject of the present invention.

FIG. 2 is an exploded view and depicts the overload element 30 in greater detail The trigger 80 is housed within barrel 85 with a compression spring 100. Spring 100 acts upon a flange 110 around the outside diameter of the trigger and a shoulder 120 around the inside diameter of the barrel 85. When the spring 100 is compressed, the tapered end 82 of the trigger 80 extends partially from the barrel 85. In the preferred embodiment, when the spring 100 is relaxed, the trigger 80 is housed completely within the barrel 85. Insulator cap 33 is plastic and extends over the end of barrel 85 protecting the trigger assembly from particles of sand 65 and heat induced in the soldering operation. In the preferred embodiment, the heater element 90 includes an aperture 92 in its base 93 which allows the tapered end 82 of the trigger 80 to extend partially through the heater element 90. In the preferred embodiment, the heater element is made of a copper alloy including zinc or nickel.

In the pre-operated state shown in FIG. 3A, spring 100 is compressed as the tapered end 82 of the trigger 80 extends through the aperture 92 in the heater element 90 and out of the barrel 85. The trigger 8 is electrically and mechanically attached to the short circuit strip 70 by a mass of calibrated, fusible alloy 150 between a blade 84 formed at the end of strip 70 and a slot 83 in the tapered end 82 of trigger 80. In the preferred embodiment, the calibrated alloy is an alloy of tin and bismuth. The trigger 80 is also attached to the heater element 90 by a second circular mass of fusible alloy 152 encircling tapered end 82 where it extends through aperture 92.

FIG. 3B depicts the fuse 10 in the post-operation state. In the event of a sustained overload, heat is transferred to mass 150 from the short circuit strip 70 and to mass 152 by heater element 90 where upon both masses melt simultaneously allowing the spring 100 to extend to a relaxed position carrying the trigger 80 inside barrel 85 and away from the short circuit strip 70, thereby opening the circuit.

A novel aspect of the invention relates to the heater element's ability to enclose the overload element thereby centering the element, fixing the length of the element and providing a weldable surface between the element 20 and the end cap 50. As shown in FIG. 2, the heater element 90 includes a base 93 having aperture 92, two legs 94 R,L and two tabs 96 R,L formed at the ends of each leg. Legs 94 R,L are slightly longer than barrel 85 and, when extended at a 90 degree angle from base 93, extend past the end of barrel 85 and insulator 33. In the preferred embodiment, tabs 96 L,R are formed in a "T" shape at the ends of legs, opposite base 93. Each tab is designed to be folded inward over the insulator 33 at a 90 degree angle to the leg. Both tabs meet at the end of the fuse to form a weldable surface having outwardly radiused ends visible in FIG. 4.

FIG. 4 is an end view of the fuse and depicts the identical heater element tabs 96 L,R in their closed position. Both tabs have one long side 175 and one short side 178 where the tab is attached to the leg. When the tabs 96 L,R are folded together in the closed position over the end of the overload element, the long sides 175 of the tabs are arranged together and the resulting surface can be soldered to the metallic end cap without the need for a separate washer. In the preferred embodiment, the solder used between the end cap and the surface formed by the tabs is an alloy of tin and lead.

In addition to forming a soldering surface, the tabs also serve to center and fix the length of the overload element 30 in the tube between the time the fuse is assembled and the cap is soldered to the tabs 96 L,R. The curved ends 177 of the tabs form a surface having a diameter slightly less than the inside of metallic end cap 50, thereby retaining the overload element in the center of the cap.

Additionally, as can be appreciated in FIG. 1, the tabs serve to index the element at a point in the fuse body. Because the diameter of the surface formed by the tabs 96 L,R is slightly greater than the inside diameter of the fuse tube 40, the overload assembly 30 is retained at the edge of the fuse tube, thus fixing the length of the overload element 30 in the tube 40.

An additional advantage of the heater element 90 with its integral tabs 96 L,R is the ease with which the fuse can be assembled. For example, the short circuit 20 and over load 30 elements are first mechanically and electrically connected to each other in series. Thereafter, the plastic insulator 33 is placed over the end of the barrel 85 and the tabs 96 L,R are folded over the insulator 33 creating the weldable surface. The entire assembly is then placed within the fuse housing 40 and the end cap 50 is placed over the end of the housing 40. In the preferred embodiment, external heat is applied to the end cap 50 externally until pre-flowed solder in the interior of the end cap 50 flows and attaches the end cap 50 to the weldable surface formed by tabs 96 L,R.

It will be understood by those skilled in the art that the tabs 96 L,R need not be exactly as described but could form a variety of different shapes and still be within the purview of the invention so long as the tabs form a weldable surface between the end of the fuse and the fusible elements. For example, the heater element could have only one leg with a circular shape formed at its end in place of the tabs. The circular shape could serve as a weldable surface and also center and index the elements within the fuse body.

As the forgoing demonstrates the present invention solves the problem of attaching a fusible element to a metallic end cap without a separate washer. The invention also solves the problems associated with centering and indexing a fusible element in a cap prior to welding between the time the fuse is assembled and the time the end cap is soldered to the overload element through induced current.

While the dual element fuse of the present invention has been described by reference to its preferred embodiment, it will be understood that other various embodiments of the device of the present invention may be possible by reference to the specification and the appended claims. Such additional embodiments shall be included within the scope of the appended claims.

We claim:

1. A dual element, ferrule fuse comprising:

a tubular body having first and second ends;

a first and second metallic end caps constructed and arranged to fit over said first and second ends of said tubular body in a telescopic manner;

a short circuit element including at least one short circuit strip within said tubular body, said strip electrically and mechanically connected at a first end to said first end cap at said first end of said tubular body;

an overload protection element between a second end of said short circuit strip and said second end cap, said overload protection element electrically and mechanically connected to said second end of said short circuit strip; and means cooperating with said body, said second end cap and said overload protection element, for electrical and mechanical connection of said overload protection element to said second metallic end cap, centering of said overload protection element within said end cap and axial retention of said overload protection element within said second end of said tubular body;

whereby, said elements may be assembled within said tubular body and said overload protection element will be centered and retained in the desired position at said second end of said tubular body until said second end cap is installed over said second end of said tubular body and is soldered to said overload protection element by external heating.

2. The dual element, ferrule fuse in claim 1, whereby said overload protection element includes:

a substantially cylindrical trigger having a tapered end attached with a first fusible alloy to said second end of said short circuit strip;

a substantially cylindrical barrel annularly disposed around said trigger, said barrel having first and second ends, said tapered end of said trigger constructed and arranged to extend through said first end of said barrel;

spring means acting between said trigger and said barrel; and a heater element having a base portion, said base portion adjacent to said first end of said barrel and having a substantially circular aperture therein, said tapered end of said trigger extending through said aperture and said base portion attached with a second fusible alloy to said tapered end of said trigger at said aperture.

3. The dual element, ferrule fuse in claim 2, whereby a second end of said trigger has an outwardly facing flange around the perimeter thereof and said first end of said barrel has an inwardly facing shoulder around the perimeter thereof and said spring means is a coiled compression spring constructed and arranged to be held in compression between said flange and said shoulder when said tapered end of said trigger extends through said first end of said barrel.

4. The dual element, ferrule fuse in claim 3, whereby upon the occurrence of an electrical overload said first and second fusible alloys melt and said coiled compression spring acts against said flange and said shoulder, thereby moving said trigger away from said short circuit strip and interrupting an electrical current through said fuse.

5. The dual element, ferrule fuse in claim 4, whereby means for electrical and mechanical connection of said overload protection means to said second metallic end cap, centering of said overload protection means within said end cap and retention of said overload protection mean within said second end of said tubular body includes:

a pair of legs integrally formed at opposite edges of said base portion of said heater element, said legs constructed and arranged to extend at an angle of substantially 90 degrees from said base plate past the end of said barrel;

a pair of tabs, each located at the distal end of said legs opposite said base portion, said tabs each having one long side, one short side opposite said long side and two curved ends, said tabs constructed and arranged to be folded towards each other over the end of said barrel and forming a substantially flat welding surface at the end of said barrel.

6. The dual element, ferrule fuse in claim 5, whereby the outside diameter of said welding surface formed by said tabs is slightly smaller than the inside diameter of said metallic end cap, thereby holding said overload device in the center of said metallic end cap.

7. The dual element, ferrule fuse in claim 6, whereby the diameter of said welding surface formed by said tabs is slightly larger than the inside diameter of said tubular body, thereby axially retaining said overload device at the second end of said tubular body.

* * * * *